US010144566B2

(12) United States Patent
O'Regan et al.

(10) Patent No.: US 10,144,566 B2
(45) Date of Patent: Dec. 4, 2018

(54) HIGH STRENGTH CABLE TIE ARRANGEMENT

(71) Applicant: Electrical Materials Company, Genoa City, WI (US)

(72) Inventors: Timothy J. O'Regan, Park Ridge, IL (US); Frank J. Wolfard, Hebron, IL (US); Timothy M. O'Regan, Chicago, IL (US)

(73) Assignee: ELECTRICAL MATERIALS COMPANY, Genoa City, WI (US)

( * ) Notice: Subject to any disclaimer, the term of this patent is extended or adjusted under 35 U.S.C. 154(b) by 0 days.

(21) Appl. No.: 13/762,762

(22) Filed: Feb. 8, 2013

(65) Prior Publication Data

US 2014/0223696 A1 Aug. 14, 2014

(51) Int. Cl.
*B65D 63/10* (2006.01)

(52) U.S. Cl.
CPC ..... *B65D 63/1072* (2013.01); *Y10T 24/1498* (2015.01)

(58) Field of Classification Search
CPC ..... B65D 63/10; B65B 27/00; B65B 27/083
USPC ..... 24/16 PB, 17 AP, 30.5 P, 16 R, 20 K
See application file for complete search history.

(56) References Cited

U.S. PATENT DOCUMENTS 3,257,694 A * 6/1966 Litwin ..... 24/16 PB
3,471,109 A * 10/1969 Meyer ..... 248/68.1
3,837,047 A * 9/1974 Bunnell ..... 24/16 PB
4,079,485 A 3/1978 Collier et al.
4,154,418 A * 5/1979 Wiese ..... 248/316.1
4,272,870 A * 6/1981 McCormick ..... 24/16 PB
4,287,644 A * 9/1981 Durand ..... 24/16 PB
4,951,362 A * 8/1990 Denemark et al. ..... 24/16 PB
4,958,414 A 9/1990 Benoit
5,293,669 A * 3/1994 Sampson ..... 24/16 PB
5,363,536 A * 11/1994 Kleeman ..... 24/30.5 P
5,414,904 A * 5/1995 Sampson ..... 24/16 PB
5,745,957 A * 5/1998 Khokhar et al. ..... 24/16 PB
5,890,265 A * 4/1999 Christian et al. ..... 24/16 PB
5,911,367 A 6/1999 McInerney
6,076,234 A * 6/2000 Khokhar et al. ..... 24/16 PB
6,594,867 B1 7/2003 Pettersson
7,334,299 B2 2/2008 Assarsson
7,730,592 B2 * 6/2010 Krisel ..... 24/16 PB

* cited by examiner

*Primary Examiner* — Robert Sandy
(74) *Attorney, Agent, or Firm* — Greer Burns & Crain, Ltd.

(57) ABSTRACT

A cable tie of unitary structure includes a flexible, elongated band having a linear array of first inclined teeth on a first surface thereof and a retaining housing and a tapered portion on opposed ends of the band. The housing includes an elongated slot aligned with the band for receiving the band's tapered end portion in sliding engagement to form a closed loop for receiving and retaining plural aligned elongated elements such as cables. Upper and lower surfaces of the housing include respective plural spaced slots defined by respective upper and lower spaced crossed members aligned transverse to the length of the band when inserted in the slot. Inner distal ends of each of the lower cross members are each provided with respective plural sets of second inclined teeth each adapted to engage a respective one of the first teeth on the band to securely maintain the cables in fixed position.

10 Claims, 4 Drawing Sheets

12
26a
26b
10
16
28
52c
52b
18
14
52a
46
44
42

12
24a
24b
10
28
16
18
14

12
26b
26a
10
16
30
32
49
47
18
14
43
45

12
24a
24b
10
30
16
32
48d
50d
48c
50c
48b
14
50b
48a
18
50a

FIG. 5
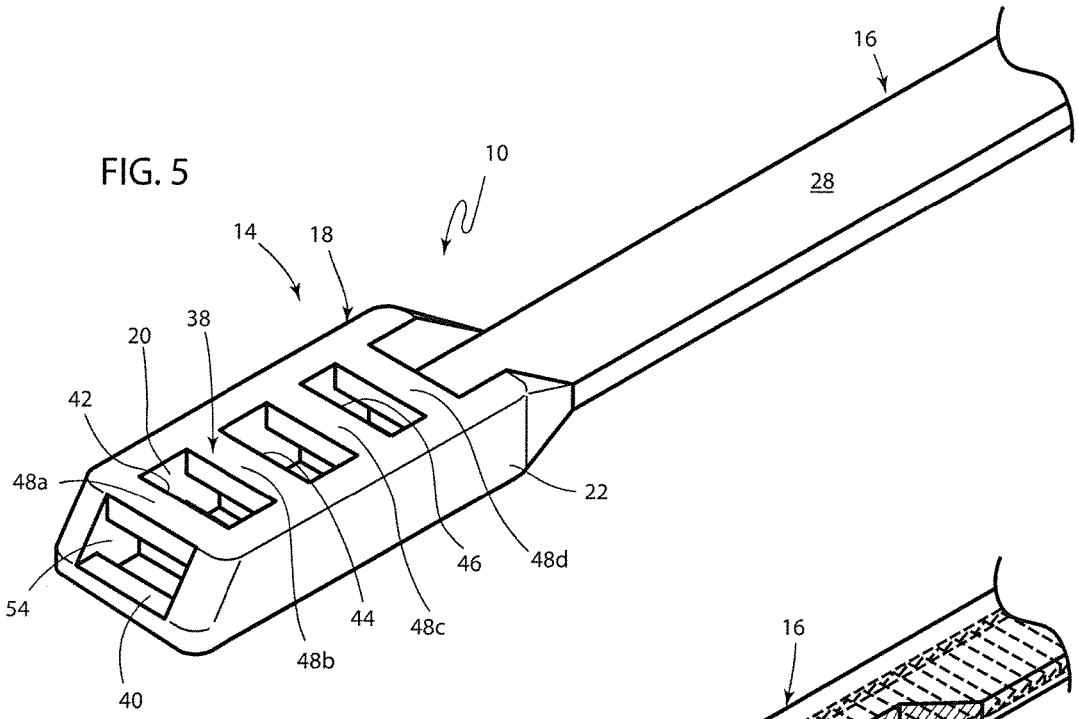
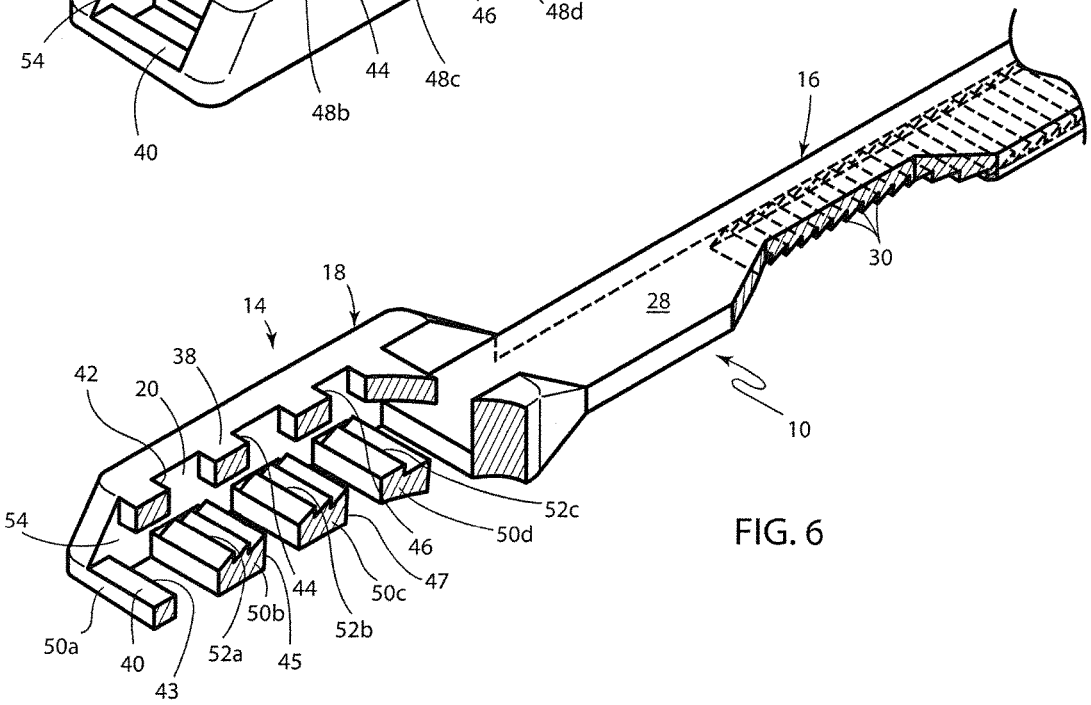
FIG. 6

HIGH STRENGTH CABLE TIE ARRANGEMENT

FIELD OF THE INVENTION

This invention relates generally to apparatus for securely maintaining plural elongated members in a tight bundle, and is particularly directed to a cable tie arrangement which is easily attached to, and provides high strength restriction/confinement of, the cables.

BACKGROUND OF THE INVENTION

Bundle fasteners are used to engage and prevent relative movement between plural elongated members. One type of bundle fastener is a cable tie commonly used to maintain elongated members such as insulated conductors, or cables, in a tight bundle. This type of cable tie is in the form of an elongated, flexible strap typically comprised of a synthetic plastic material having on a first end thereof a housing with a slot therein which is adapted to receive a second, opposed end of the strap. Disposed along one surface of the strap is a linear array of first spaced teeth, while disposed within and defining a portion of the slot of the housing is an inner array of second spaced teeth. When the strap is looped back upon itself and its second end is inserted into the slot in the housing on the strap's first end, the first and second sets of teeth are drawn into, and maintained in, tight fitting engagement.

These types of cable ties are increasingly used for engaging and restraining larger numbers of cables having a corresponding greater weight requiring a greater restraining force. As the strength requirements of these types of tying arrangements have increased, the likelihood of damaging or deforming the mutually engaging sets of teeth has also increased resulting in increased failure rates. The strength and rigidity of the individual teeth is limited in currently available bundle tie arrangements by the requirement to slide one set of teeth over the other set during positioning of the tie arrangement about and in contact with the members to be restrained. Many current approaches include a positioning member movable between a lowered use position to engage the strap teeth and a raised position to release the pivoting member, or pawl, from between the strap teeth in releasing the tie. The pivoting pawl is the weakest part of this type of cable tie arrangement and the most likely to fail during use. In addition, space restrictions limit the size of the individual teeth and the coupling strength of current arrangements.

The present invention addresses the aforementioned problems and limitations of the prior art by providing a cable tie arrangement with increased coupling strength between the mutually engaging sets of teeth, as well as flexibility in the cable tie receptacle housing to facilitate secure engagement of multiple sets of teeth without deforming or breaking individual teeth.

OBJECTS AND SUMMARY OF THE INVENTION

Accordingly, it is an object of the present invention to provide an improved cable tie which provides increased restraining force on the elongated members maintained by the tie in a bundle, facilitates insertion of the cable tie's free end into its retaining housing, reduces the risk of unintended release of the cable tie, and does not employ any moving parts in the engagement between the cable tie's free end and its retaining housing.

It is another object of the present invention to facilitate, as well as increase the extent of, engagement between abutting teeth in a cable tie and to correspondingly increase the force required to break open the tie and release the restrained cables.

A further object of the present invention is to provide for the mutual engagement of multiple sets of teeth in a strap-type securing device such as, for example, a cable tie without the use of any pivoting component thus eliminating this common source of cable tie failure to provide increased restraining strength, reliability and longevity.

The present invention is directed to apparatus for engaging and fixedly positioning plural elongated members in lengthwise alignment, the apparatus comprising: a flexible elongated band having first and second opposed ends and first and second opposed outer surfaces and adapted for positioning about and engaging the plural aligned elongated members; first plural teeth disposed in a spaced manner along the first surface of said band; a housing formed integrally with, and disposed on the second end of, the band, said housing having plural inner surfaces defining an elongated slot in the housing and adapted to receive the first end of the band in sliding engagement when the band is looped back upon itself; and second plural teeth disposed on an inner surface of the housing and forming a portion of the slot in said housing, wherein respective pairs of the first and second plural teeth are adapted for mutual engagement in abutting contact for maintaining the plural elongated members in fixed position and lengthwise alignment relative to one another; wherein each of the adjacent first and second teeth arranged in abutting contact includes a respective tapered edge portion, and wherein adjacent tapered edge portions of abutting first and second teeth extend in opposing directions and are arranged in an overlapping manner with one another along the length of the band to provide increased coupling strength engagement between adjacent abutting teeth.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 5 is a partial perspective view of the inventive high strength cable tie illustrating details of the cable tie housing;

FIG. 6 is also a perspective view of the housing portion of the high strength cable tie, where portions of the housing and the flexible, elongated band portion are shown partially cutaway;

DETAILED DESCRIPTION OF THE PREFERRED EMBODIMENTS

Figures 1, 2, 3, 4:
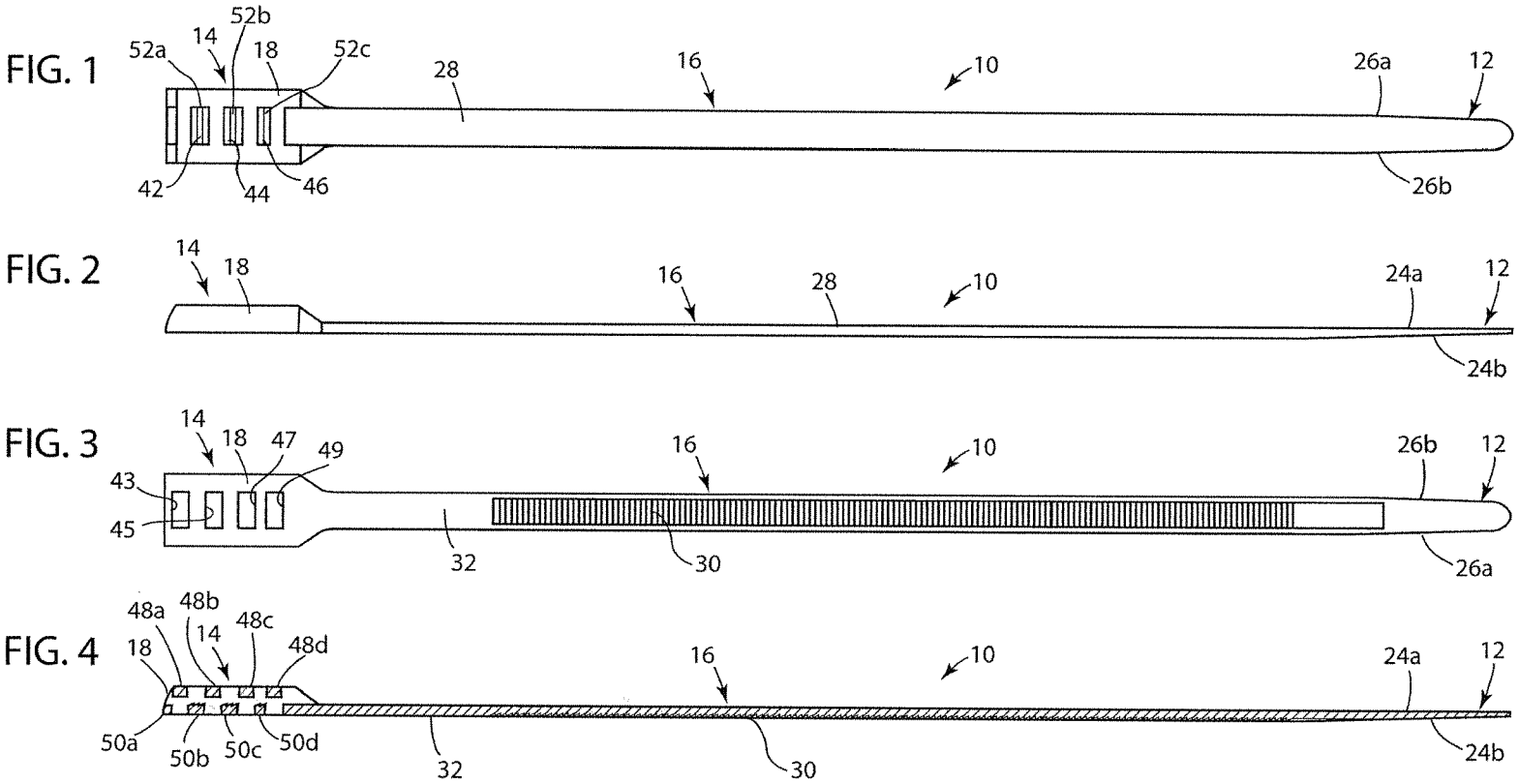
FIG. 1 is a top plan view of a high strength cable tie in accordance with one embodiment of the present invention shown in the nonuse, generally flat configuration.
FIG. 2 is a side elevation view of the inventive high strength cable tie shown in FIG. 1.
FIG. 3 is a bottom plan view of the inventive high strength cable tie.
FIG. 4 is a longitudinal sectional view of the inventive high strength cable tie.

Referring to FIGS. 1, 2, 3 and 4, there are respectively shown top plan, side elevation, bottom plan, and longitudinal sectional views of a cable tie arrangement 10 in accordance with the principles of the present invention. Cable tie arrangement 10 includes a first tapered end portion 12 and a second, opposed end portion 14. Disposed on the second end portion 14 is a receptacle housing 18 which is adapted to receive the first tapered end portion 12 in tightfitting engagement as described below. Disposed between the first and second end portions 12, 14 is an intermediate flexible, elongated band portion 16. The first tapered end portion 12 is defined by tapered upper and lower surfaces 24*a*, 24*b* and tapered first and second opposed lateral edges 26*a*, 26*b*. The inner band portion 16 is provided with a flat, smooth upper surface 28 and a lower surface 32 which includes plural spaced inclined first teeth 30. The intermediate band portion 16 with its tapered end portion 12 is commonly referred to as the "strap" portion of the cable tie arrangement 10.

Figure 7:
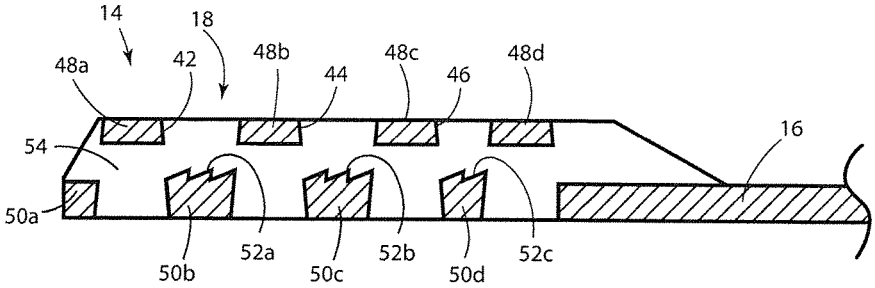
FIG. 7 is a longitudinal sectional view of the cable tie's housing.
Figure 9:
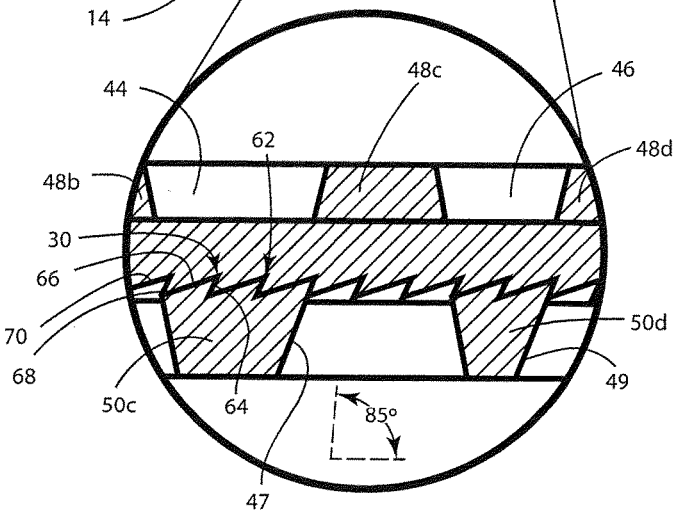
FIG. 9 is a longitudinal sectional view of the cable tie's housing with the band portion inserted through the housing, and with the two sets of retaining teeth in mutual engagement and with a lower portion of the figure illustrating a partial enlarged sectional view of the strap and housing portions in mutual engagement.
Figure 10:
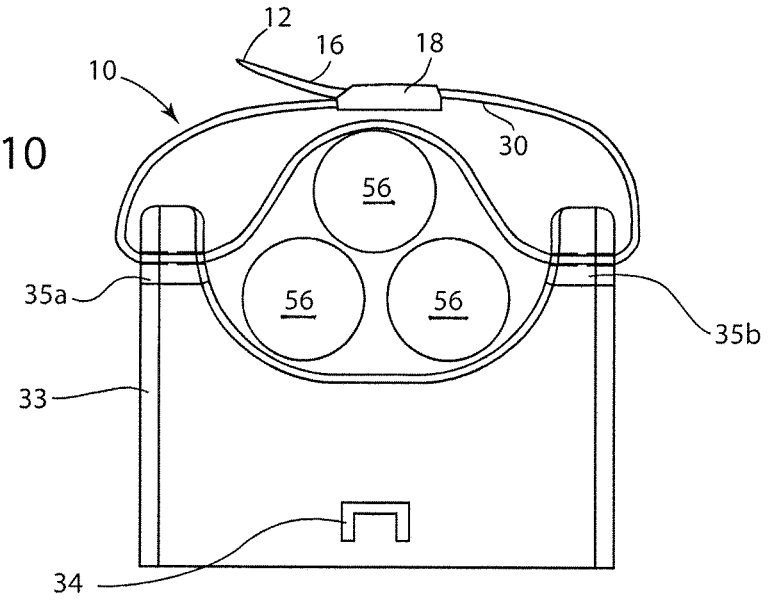
FIG. 10 is a side elevation view of the inventive high strength cable tie shown disposed about and maintaining plural elongated members, such as cables, bound together and secured to a cable support member.

Referring to the perspective and partially cutaway perspective views of FIGS. 5 and 6, additional details of the receptacle housing 18 of the cable tie arrangement 10 are illustrated. In addition, in the following discussion reference will also be made to FIGS. 7, 8 and 9 which are longitudinal sectional views of the cable tie arrangement's receptacle housing 18 with and without the band portion 16 inserted therein. Finally, FIG. 10 is a side elevation view of the cable tie arrangement 10 shown positioned about and engaging plural aligned elongated members, such as cables, 56, where a portion of the cable tie arrangement is shown in section.

The cable tie arrangement's receptacle housing 18 and its band portion 16 are preferably in the form of a unitary structure comprised of a plastic material, such as polypropylene. Receptacle housing 18 is generally rectangular in shape and includes an inner elongated slot 54 extending the length of the housing and generally rectangular in cross-section. Receptacle housing 18 includes first and second lateral walls 20, 22, a top panel 38, and a floor panel 40, all of which are generally planar. Band portion 16 is highly resilient and flexible, while housing 18 is more rigid because of its rectangular shape, but also possesses resilience in its lateral walls 20, 22 and top and floor panels 38, 40. This resilience allows the top and floor panels 38, 40 to flex slightly as the edges of first teeth 30 and the edges of second teeth 62 in the form of first, second and third teeth arrays 52*a*, 52*b* and 52*c* pass over one other in the cable tie during closure of the cable tie. This flexibility in the cable tie's receptacle housing is, however, limited to ensure the application of full force engagement between the interlocking teeth upon the application of a force on the cable tie arrangement 10. Disposed within the top panel 38 and arranged in a spaced array are first, second and third upper apertures 42, 44 and 46. Similarly, disposed along the length of the housing's floor panel 40 are first, second, third and fourth lower apertures 43, 45, 47 and 49. Disposed between adjacent upper apertures are first-fourth top panel cross members 48*a*-48*d*, while disposed in a spaced manner and forming the floor panel 40 are first-fourth floor panel cross members 50*a*-50*d*. Disposed on the respective upper surfaces of the second through fourth floor panel cross members 50*b*, 50*c* and 50*d* are respective second teeth 62 in the form of first, second and third teeth arrays 52*a*, 52*b* and 52*c*.

Figure 8:
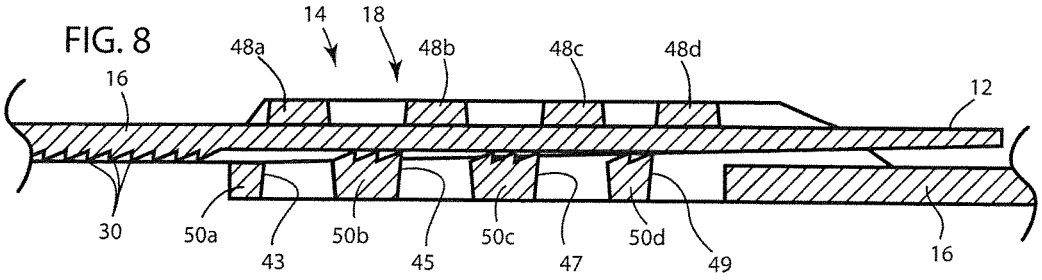
FIG. 8 is a longitudinal sectional view of the cable tie's housing with the end portion of the cable tie's band inserted into the housing.
Figure 8:
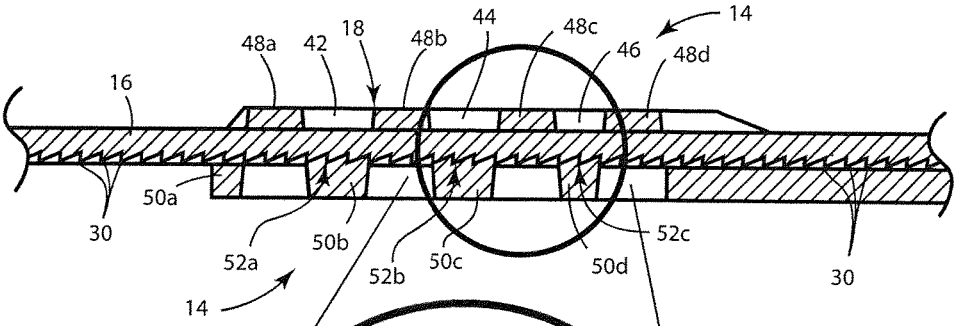

When the first tapered end portion 12 of the band portion 16 is inserted into the elongated slot 54 extending the length of the receptacle housing 18 as shown in the cross-sectional view of FIG. 8, the upper and lower surfaces of band 16 respectively engage the top panel cross members 48*a*-48*d* and the floor panel cross members 50*a*-50*d*. Continued displacement of the band portion 16 through the elongated slot 54 in receptacle housing 18 in a leftward direction as shown in FIGS. 8 and 9 causes the plural spaced inclined teeth 30 on the lower surface, as viewed in FIG. 9, of the band portion 16 to engage the first through third tooth arrays 52*a*, 52*b* and 52*c* respectively disposed on the distal, or upper, ends of the second, third and fourth floor panel cross members 50*b*, 50*c* and 50*d* as shown in FIG. 9. The engagement of the plural spaced inclined teeth 30 on the band portion 16 with the three tooth arrays 52*a*, 52*b* and 52*c* respectively disposed on the second, third and fourth floor panel cross members 50*b*, 50*c* and 50*d* fixedly attaches the band portion to the reciprocal housing 18 preventing withdrawal of the band portion from the housing.

As shown in greater detail in the lower enlarged portion of FIG. 9, each of the teeth 30 on band 16 includes a respective forward wall 64 inclined toward the right as shown in FIG. 9, and an adjacent aft wall 66. Similarly, each tooth in each of the first, second and third tooth arrays 52*a*, 52*b* and 52*c* has a respective forward wall 48 and an adjacent aft wall 70. Each of the forward and adjacent aft walls of the second teeth 62 in each of the three tooth arrays 52*a*, 52*b* and 52*c* is adapted to engage in abutting contact the respective forward and adjacent aft walls of a tooth within the array of teeth 30 on the band portion 16 of the cable tie arrangement 10. It is the contact between adjacent and abutting forward walls in the first and second sets of teeth respectively disposed on the floor panel cross members 50*b*-50*d* and on the band portion 16 which locks the band portion to the receptacle housing 18 and securely maintains these two components in intimate contact with one another. As shown in dotted line form in the lower portion of FIG. 9, the angle of inclination of each of the second teeth 62 disposed on the floor panel cross members 50*b*, 50*c* and 60*d* is preferably inclined in the forward direction, or to the right as viewed in FIG. 9, relative to the longitudinal axis of band portion 16. Similarly, each forward wall 46 of a second tooth 62 in the band portion 16 is inclined in the aft direction, or to the left as viewed in FIG. 9, relative to the longitudinal axis of the band portion. This extended angle of inclination of the interlocking teeth on the floor panel cross members as well as on the band portion 16 increases the overlapping extent of engagement these two components and the overall strength of the cable tie arrangement 10. Thus, by providing the individual teeth in mutual engagement with an angled overbite along the axis of the force applied to the band portion 16 and to the receptacle housing 18, the mutual engagement between the two interlocking teeth arrays and the retention strength of the cable tie arrangement 10 is substantially increased.

Another advantage of the present invention is in the use of plural spaced floor panel cross members 50*a*-50*d*, where the upper, inner portions of three of these cross members are provided with first, second and third tooth arrays 52*a*, 52*b* and 52*c*. By segmenting the floor panel 40 of the receptable housing 18, the individual floor panel cross members have some flexibility and are able to undergo limited downward displacement as viewed in FIGS. 7-9 during insertion of the band portion 16 into the elongated slot 54 of the receptacle housing. This displacement of the individual floor panel cross members 50*b*-50*d* in a direction generally transverse to the direction of insertion of the band portion 16 into the receptacle housing 18 facilitates insertion of the band portion into and through the slot 54 in the receptacle housing. This transverse displacement of the three floor panel cross members 50*b*-50*d* occurs when the crests, or highest points, of the first and second sets of teeth on the band portion 16 and on the three floor panel cross members are in abutting engagement. Upon further relative displacement between the band portion 16 and the receptacle housing 18, the crest portion of each tooth will become aligned with and positioned within an adjacent recessed portion in the other tooth array. This inward and outward displacement of each of the three floor panel cross members 50*b*-50*d* facilitates relative movement between the crest portions of adjacent teeth in each of the two sets of teeth, while permitting full and complete engagement of the crest portion of each tooth of a first set with the recessed portion of an adjacent and abutting tooth in the other set of teeth. This resilient flexibility in the receptacle housing 18 of the cable tie arrangement 10 allows for the use of stronger and harder materials in the composition of the cable tie arrangement for increased strength, reliability and longevity.

Referring to FIG. 10, there is shown a side elevation view of the inventive high strength cable tie arrangement 10 shown disposed about and maintaining plural elongated members, such as cables, 56 bound together and attached to a cable support member 33. Cable tie arrangement 10 is inserted through first and second aligned slots 35*a* and 35*b* within the cable support member 33 in a manner such that plural cables 56 are disposed between the cable tie arrangement and a recessed portion of the cable support member. The cable tie arrangement 10 is then pulled tight and secured as described above to securely maintain the cables 56 attached to the cable support member 33 in a fixed manner. Cable support members 33 includes a third slot 34 therein which is adapted to receive a plastic slider (not shown for simplicity) for supporting the support member and attached cables.

While particular embodiments of the present invention have been shown and described, it will be obvious to those skilled in the relevant arts that changes and modifications may be made without departing from the invention in its broader aspects. For example, while the present invention has been described primarily in terms of a cable tie arrangement, it could be as equally as well for tying together in a secure manner plural elongated members having virtually any cross sectional shape and virtually any composition. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. Apparatus for engaging and fixedly positioning plural elongated members in lengthwise alignment, said apparatus comprising:

a flexible elongated band having first and second opposed ends and first and second opposed outer surfaces and adapted for positioning about and engaging the plural aligned elongated members;

first plural teeth disposed in a spaced manner along the first outer surface of said band;

a housing formed integrally with, and disposed on the second end of said band and extending outwardly relative to said elongated band in the direction of its second outer surface, said housing having plural inner surfaces defining a single elongated slot in said housing and adapted to receive the first end of said band in sliding engagement when said band is looped back upon itself; and plural resilient first cross members forming a first portion of the housing's slot and aligned in a spaced manner along the length of said slot, with each of said first cross members having a respective generally flat outer surface and a respective inner surface, and further wherein a group of said plural resilient first cross members includes disposed thereon respective sets of plural second teeth that are configured and arranged for engaging said first plural teeth on said band, but wherein an initial one of said resilient first cross members, which is located closest to a distal end portion of said second opposed end of said flexible elongated band, lacks teeth thereon, and still further wherein said spaced first cross members provide flexibility to said housing to facilitate insertion of the band into the housing's slot; and plural second cross members forming an opposed second portion of the housing's slot and aligned in a spaced manner along the length of the slot, wherein each of said plural second cross members includes a respective inner surface adapted to engage the second outer surface of said band to maintain said first and second plural teeth in intimate mutual engagement, and wherein each of the first and second cross members is tapered such that its inner surface forming a portion of said slot is greater in size than its outer surface to provide increased housing flexibility and an increased number of second teeth engaging said first teeth;

wherein each of said adjacent first and second teeth arranged in abutting contact includes a respective tapered edge portion, and wherein adjacent tapered edge portions of abutting first and second teeth extend in opposing directions and are arranged in an overlapping manner with one another along the length of said band to provide increased coupling strength engagement between adjacent abutting teeth for maintaining the plural elongated members in fixed position and lengthwise alignment relative to one another.

2. The apparatus of claim 1, wherein the tapered edge portions of each of said first and second plural teeth have an included angle on the order of 85°.

3. The apparatus of claim 2, wherein the tapered edge portions of each of said second plural teeth extend in the direction in which said band is inserted in the housing's elongated slot.

4. The apparatus of claim 1, wherein the inner surface of said housing forming the first portion of the housing's slot includes the group of said plural resilient first cross members, and the group is formed of three spaced first cross members each having two or three second teeth thereon.

5. The apparatus of claim 1, wherein said band, housing and first and second teeth are integrally formed as a single piece of molded plastic.

6. The apparatus of claim 5, wherein said molded plastic is polypropylene.

7. The apparatus of claim 1, wherein said housing extends outwardly from said second outer surface of said band, thereby extending from an opposite surface of said band than said first plural teeth, which extend outwardly from said first outer surface of said band.

8. The apparatus of claim 1, wherein said first teeth and said second teeth are of the same shape.

9. The apparatus of claim 1, wherein said housing includes first and second lateral walls, and further wherein each of said first cross members is connected to both said first lateral wall of said housing and said second lateral wall of said housing, and thus said first cross members are not configured and arranged for pivoting.

10. The apparatus according to claim 1, wherein the plural resilient first cross members included in said group each include at least two second teeth thereon.

* * * * *